United States Patent [19]

Heynisch et al.

[11] Patent Number: 4,803,397

[45] Date of Patent: Feb. 7, 1989

[54] INDIRECTLY HEATED DISPENSER METAL CAPILLARY CATHODE FOR ELECTRICAL DISCHARGE DEVICES

[75] Inventors: Hinrich Heynisch, Graefelfing; Josef Hauser, Bad Wiessee, both of Fed. Rep. of Germany; Erwin Hübner, deceased, late of Grafing, Fed. Rep. of Germany, by Rosa Maria Hübner, legal representative

[73] Assignee: Siemens Aktiengesellschaft, Berlin and Munich, Fed. Rep. of Germany

[21] Appl. No.: 83,146

[22] Filed: Aug. 10, 1987

[30] Foreign Application Priority Data

Aug. 12, 1986 [DE] Fed. Rep. of Germany ..... 3627384

[51] Int. Cl.[4] ..... H01J 1/28; H01J 19/22

[52] U.S. Cl. ..... 313/337; 313/346 DC

[58] Field of Search ..... 313/346 DC, 337

[56] References Cited

U.S. PATENT DOCUMENTS

| | | | |
|---|---|---|---|
| 2,830,218 | 4/1958 | Beggs | 313/346 DC |
| 3,676,731 | 7/1972 | Hofmann et al. | 313/346 DC |
| 3,821,589 | 6/1974 | Katz et al. | 313/337 X |

FOREIGN PATENT DOCUMENTS

| | | | |
|---|---|---|---|
| 761089 | 4/1954 | Fed. Rep. of Germany | 313/346 DC |
| 1217503 | 5/1966 | Fed. Rep. of Germany . | |
| 2048224 | 4/1972 | Fed. Rep. of Germany . | |

OTHER PUBLICATIONS

Abstract, vol. 9 No. 173 (E329) 1896 Jul. 18, 1985 Impregnated Type Cathode 60-47331.

*Primary Examiner*—Palmer C. DeMeo

*Attorney, Agent, or Firm*—Hill, Van Santen, Steadman & Simpson

[57] ABSTRACT

A dispenser cathode such as a metal capillary cathode for electrical discharge devices which has a hollow cylindrical head portion 1 which carries a porous emission wafer 3 of a refractive material at its upper end and covers a cathode cartridge 2 which contains an active material supply 4 and comprises an epoxy helical heater 5 surrounded by a metal sleeve 6. Two part division of the structure allows separate testing possibility of the emission wafer and the heater/supply cartridge and also allows an improvement in the heat transmission from the heater to the emission wafer. For this purpose, a hollow cylindrical head portion 1 is conically-shaped and expands outwardly toward the cathode cartridge 2 and the upper part of the cathode cartridge 2 is conically tapered so as to mate with the hollow cylindrical head portion and the two portions are connected together wherein their conical side walls are attached by welding in the upper portion of the drawn up metal sleeve. The dispenser cathode can be used in travelling wave tubes for example.

3 Claims, 1 Drawing Sheet

INDIRECTLY HEATED DISPENSER METAL CAPILLARY CATHODE FOR ELECTRICAL DISCHARGE DEVICES

BACKGROUND OF THE INVENTION

1. Field of the Invention

This invention relates in general to a dispenser cathode of the indirectly heated type such as a metal capillary cathode for electrical discharge devices having a hollow cylindrical head portion which carries a porous emission wafer of refractive material which covers a cathode cartridge which contains an active material supply.

2. Description of the Prior Art

U.S. Pat. No. 3,821,589 and German DE A No. 2,048,224 disclose dispenser cathodes for electrical discharge vessels particularly metal capillary cathodes wherein active substances from an active substance supply migrate toward the cathode surface through fine openings and a porous active substance carrier covering the supply and formed in particular of porous centered refractive metal such as, for example, tungsten and wherein the active material supply is composed particularly of barium oxide which emits barium during operation. Such structures are known from German Pat. No. 1,217,503. Such cathodes are employed, for example, in travelling wave tubes and in sealed disc tubes.

Cathodes for velocity modulated tubes which in particular are designed for use in space should assure optimally high current densities at the lowest possible cathode temperature over long time spans. This problem usually requires the reduction of the electron affinity in the cathodes. Particularly, in metal capillary cathodes, this requirement can be met in that the carrier metal of tungsten in the system of carrier metal tungsten/absorbent barium is replaced by some other suitable metal or in that the absorbent barium is replaced by other elements. The first comprising wherein the variation of the carrier metal has lead to good results. The most favorable emission values have been achieved in metal capillary cathodes whose emission surfaces are vapor deposited with osmium.

So as to assure an optimally low electron affinity over an optimal operating time in such dispenser cathodes, the individual parameters must be precisely examined particularly so as to observe the required operating data so that the required properties of the cathode are not undesirably deteriorated before use.

SUMMARY OF THE INVENTION

The invention is based on a dispenser cathode which has the object of creating a separate testing possibility of the emission wafer and the heater supply cartridge and in particular for creating an improvement of the heat transmission from the heater to the emission wafer.

An object of the invention is achieved with the dispenser cathode such as a metal capillary cathode for electrical discharge devices which has a hollow cylindrical head portion which carries a porous emission wafer of a refractory metal as, for example, of porously sintered tungsten vapor deposited with Osmium and which has this at its upper end face and covers a cathode cartridge which contains an active material supply such as barium oxide and includes an epoxy helical heater which is surrounded by a metal sleeve of, for example, molybdenum wherein the hollow cylindrical head portion 1 is conically-shaped and the cathode cartridge 2 has a mating surface so that they can be connected together by welding in their outer edge of a metal sleeve 6.

Advantages of the invention particularly result from the conical formation of the side walls which produce a noticeable improvement of the heat transmission from the cathode cartridge which carries the heater to the head portion which carries the emission wafer. Further, a constant heater temperature results from the good heat transmission and this in turn results in higher reproducibility of the characteristics of different units so that the units are substantially the same. Also, the heat transition is very good and produces a relatively low heater temperature so that the reliability of the heater is considerably improved. The entire cathode structure is connected only by welds and this means that no soldering is required which produces unreliability in the cathodes. The two part division of the cathode structure allows separate testing possibilities of the emission wafer on the one hand and of the heater/supply cartridge on the other hand. Thus, two separate systems can be precisely tested before final assembly without influencing each other.

Other objects, features and advantages of the invention will be apparent from the following description and claims when read in view of the drawings in which:

DESCRIPTION OF THE PREFERRED EMBODIMENTS

Figure 1:
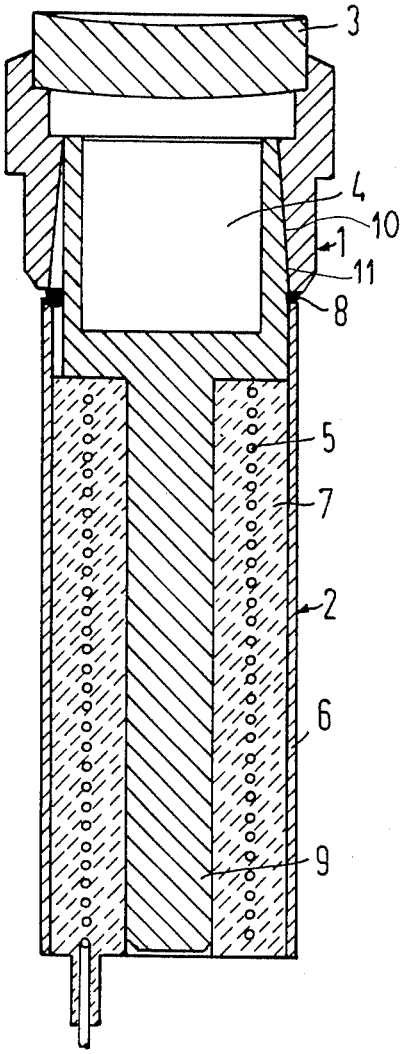
FIG. 1 is a sectional view of an indirectly heated dispenser cathode shown schematically.

FIG. 1 illustrates a metal capillary cathode formed of two parts including a hollow cylindrical head portion 1 which is preferably formed of molybdenum and which carries a porous emission wafer 3 of refractory material at its upper side face. The emission wafer 3, for example, may be formed of porous sintered tungsten which is preferably vapor-deposited with osmium. In the upper portion of the cathode cartridge 2 there is formed an upwardly extending cylindrical cavity 4 in which an active material supply which is preferably barium oxide is received. In the lower central part of the cathode cartridge 2 there is formed a heat conducting pin 9 which is surrounded by a helical heater 5 embedded in a suitable epoxy 7. The cathode cartridge 2 is surrounded by a metal sleeve 6 and the cathode cartridge 2 and the metal sleeve 6 are preferably formed of molybdenum. The hollow cylindrical head portion 1 is formed with a conical inner opening 10 which is generally truncated conical in shape and which mates with the outer surface 11 of the upper end of the cathode cartridge 2. The head portion 1 and the cathode cartridge 2 are preferably formed of molybdenum. The hollow cylindrical head portion 1 and the cathode cartridge 2 are connected to each other with a precise fit due to the mating conical sidewalls 10 and 11 as shown. The metal sleeve 6 is pulled up over the cylindrical portion of the cathode cartridge 2 to the region of the conical taper 10 of the head portion 1 and the parts are joined by a weld 8.

Figure 2:
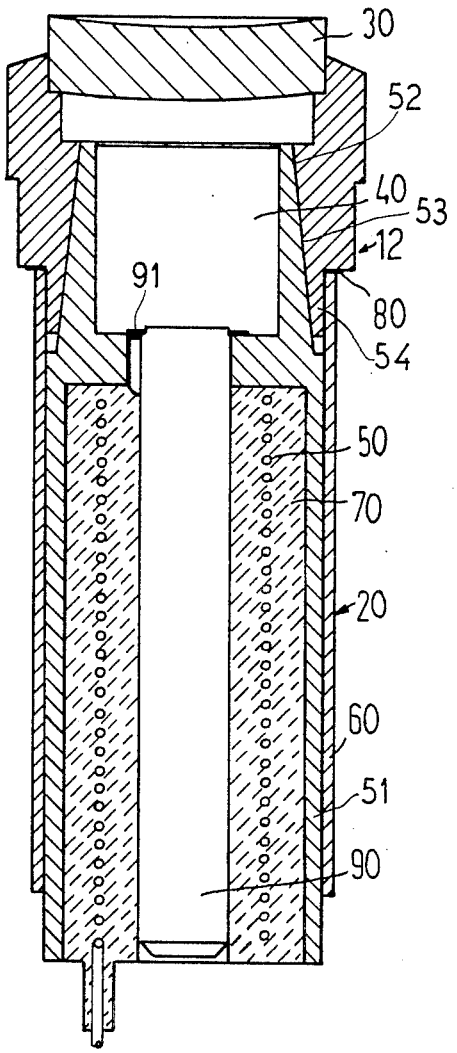
FIG. 2 is a further embodiment of an indirectly heated sensor cathode shown schematically and partially in section.

FIG. 2 illustrates a modification of the invention wherein the head portion 12 carries an emission wafer 30 of refractory metal at its upper side face and is joined to a cathode cartridge 20 which is formed with a cylindrical cavity 40 into which the active material supply such as barium oxide is placed. The center and lower portion of the cathode cartridge 20 has a heat conducting pin 90 which extends therethrough which is surrounded by a helical heater 50 which is mounted in epoxy 70. An outer cylindrical portion 51 of the cathode cartridge 20 surrounds the heater as shown. A metal sleeve 60 surrounds the cathode cartridge 20 and joins the cathode cartridge 20 to the head portion 12. The head portion 12 is formed with an inner tapered surface 52 which mates with an outer conical tapered portion 53 of the cathode cartridge 20 as shown. The metal sleeve 60 is drawn up over the cathode cartridge 20 and over an extending portion 54 of the head portion 12 and is welded by a weld 80 to the head portion 12 as shown. The cathode cartridge 20 and the sleeve 60 are formed of molybdenum. The head portion 12 is also formed of molybdenum. A weld 91 joins the pin 90 to the cartridge 20.

It is seen that the invention provides a new and novel indirectly heated dispenser cathode for electrical discharge devices and although it has been described with respect to preferred embodiments, it is not to be so limited as changes and modifications may be made which are within the full intended scope as defined by the appended claims.

We claim as our invention:

1. An indirectly heated metal capillary dispenser cathode for electrical discharge vessels, comprising, a hollow-cylindrical head portion to which a porous emission wafer of refractory metal such as, for example, porous sintered tungsten vapor-deposited with osmium is attached at its outer end face, a cathode cartridge attached to said head portion and containing an active material supply such as, for example, barium oxide, and includes a helical heater formed therein and which is surrounded by a sleeve of, for example, molybdenum, wherein said hollow-cylindrical head portion (1) has a conically-shaped opening facing said cathod cartridge (2); and said cathode cartridge (2) is conically tapered and mates with said conical opening of said hollow-cylindrical head portion (1); and said hollow-cylindrical head portion (1) and said cathode cartridge (2) are connected together by a weld (8) formed in the edge region of said metal sleeve (6).

2. An indirectly heated dispenser cathode according to claim 1, characterized in that said cathode cartridge (2) has a central portion formed as a pin which serves as a heat-conducting pin (9).

3. An indirectly heated dispenser cathode according to claim 1, characterized in that said cathode cartridge (2) has its central position shaped as a pin and has its outer part shaped as a hollow-cylinder mounted within said sleeve which surrounds said heater (5).

* * * * *